United States Patent [19]

Heisler

[11] Patent Number: 5,050,367

[45] Date of Patent: Sep. 24, 1991

[54] AUTOMATIC ON-DEMAND SEPARATING AND PLACING OF LIDS

[76] Inventor: Raymond A. Heisler, 657 Dokota Trail, Franklin Lakes, N.J. 07417

[21] Appl. No.: 665,773

[22] Filed: Mar. 7, 1991

[51] Int. Cl.[5] ..... B65B 7/28

[52] U.S. Cl. ..... 53/72; 53/67; 53/313; 53/367; 53/505

[58] Field of Search ..... 53/72, 67, 505, 506, 53/77, 313, 316, 315, 314, 307, 309, 310, 485, 367; 221/211, 212, 297

[56] References Cited

U.S. PATENT DOCUMENTS

| | | | |
|---|---|---|---|
| 2,340,639 | 2/1944 | Brinton et al. | 53/72 |
| 3,332,209 | 7/1967 | Knudsen | 53/313 |
| 3,350,842 | 11/1967 | Renish | 53/316 |
| 3,460,314 | 8/1969 | Keas | 53/72 |
| 3,924,384 | 12/1975 | Kinney | 53/314 X |
| 3,938,697 | 2/1976 | Kinney | 53/313 X |
| 4,122,649 | 10/1978 | Sawvel | 53/314 X |
| 4,312,172 | 1/1982 | Fisher et al. | 53/72 X |
| 4,601,160 | 7/1986 | Heisler | 53/316 X |
| 4,683,706 | 8/1987 | Harper | 53/316 X |
| 4,959,944 | 10/1990 | Heisler | 53/313 |

*Primary Examiner*—James F. Coan

*Attorney, Agent, or Firm*—Patrick J. Pinto

[57] ABSTRACT

An improved apparatus for the feeding and placing of a preformed cover(44) on a linearly advancing preformed container(130), said improved apparatus being automatically operated in response to an "on-demand" condition, said improved apparatus including a frame assembly(12), an inclined hopper assembly(14), a cover separating assembly(16), a transfer chute assembly (18) an infeed conveyor assembly(20), and a cover seating assembly(22). This improved apparatus may also provide selective orientation of a pour spout or bung located in a circular cover.

27 Claims, 8 Drawing Sheets

AUTOMATIC ON-DEMAND SEPARATING AND PLACING OF LIDS

BACKGROUND OF THE INVENTION

1. Field of the Invention

This invention is believed to be found in the field of "PACKAGE MAKING" and more particularly in the field of "SEPARATING A CLOSURE FOR LATER SELECTION BY A MOVING CONTAINER".

2. Description of the Prior Art

Apparatus for placing lids on containers are well known in the art. Some examples of known prior art are exemplified by U.S. Pat. No. 3,332,209 as issued to Knudsen on 07/25/67; U.S. Pat. No. 3,350,842, as issued to Renish on 11/07/67; U.S. Pat. No. 3,460,314 as issued to Keas on 08/12/69; U.S. Pat. No. 3,924,384 as issued to Kinney on 12/09/75; U.S. Pat. No. 4,122,649 as issued to Sawvel on 10/31/78; U.S. Pat. No. 4,312,172 as issued to Fisher et al on 01/26/82; my U.S. Pat. No. 4,601,160 issued 07/22/86; U.S. Pat. 4,683,706 as issued to Harper on 08/04/87; and my U.S. Pat. No. 4,959,944 issued on 10/02/90. U.S. Pat. No's. 4,601,160 and 4,959,944 are soley owned by me and are incorporated into this application by referenced to the extent the law allows. The known prior art utilize a mechanical or suction means for removing the first cover from a nested stack. More particularly Knudsen '209 teaches the use of a reciprocating pawl to engage the lip of the cover to provide separation of the first cover from the nested stack. Renish '842 teaches the use of a suction device in cooperation with an indexing turret for providing the separation of the first cover from the nested stack. Suction devices are also shown in Keas '314; and Sawvel '649. Fisher '172 teaches the use of a selectively rotated threaded rod for advancing the nested stack towards an aperture (15). Kinney '384 delivers the separated covers to a rotary indexing table. Harper '706 teaches the use of a plurality of pivoting gate mechanisms to separate the first cover Harper further teaches the orientation of a circular lid by means of a rotating arm.

The use of suction cups as taught by others requires that portions of the cover be flat in order for individual suction cups to be effective. The mechanical gating means as disclosed by Harper requires precise adjustment and does not allow for variations in diameter or thickness of covers. Fishers threaded rod advancing mechanism requires that the flow of containers be stopped in order to replenish the cover supply.

These are but a few of the deficiencies of the prior art which the present invention overcomes.

SUMMARY OF THE INVENTION

This invention may be summarized, at least in part, with reference to its objects. It is an object of this invention to provide an improved apparatus for the automatic on-demand separating of a preformed cover from a nested stack and subsequently placing the separated cover on a traveling container.

It is another object of this invention to provide an improved apparatus for the separating of a cover from a nested stack which is compact in length and provides a signal to stop advancement of the container as and when a cover is not in position for placing on a :raveling container.

It is a further object of this invention to provide an apparatus which may be adapted for separating either rectangular covers or circular covers from a nested stack.

It is still a another object of this invention to provide and it does provide an improved apparatus for the orientation of an opening in a circular cover with respect to placement on a container.

In addition to the above summary, the following disclosure is detailed to insure adequacy and aid in the understanding of the invention. This disclosure, however, is not intended to cover each new and and inventive concept, no matter how it may later be disguised either by variations in form or additions by further improvements. For this reason, there have been chosen specific embodiments of an apparatus for separating and placing preformed lids on containers. This improved apparatus is adapted for use with conveying equipment used in filling and packaging operations. These specific embodiments have been chosen for the purpose of illustration and description, as shown in the accompanying drawings wherein:

BRIEF DESCRIPTION OF THE DRAWINGS

In the following description and in the claims, various details are identified by specific names for convenience. These names are intended to be generic in their application. The corresponding reference characters refer to like members throughout the several figures of drawings.

The drawings accompanying, and forming a part of this specification disclose certain details of construction associated with a preformed cover separating and placing apparatus. These details are for the purpose of explanation, but structural details may be modified without departure from the concept and principles of the present invention. It is anticipated that this invention may be incorporated in forms other than as shown.

DESCRIPTION OF THE PREFERRED EMBODIMENT

Figure 1:
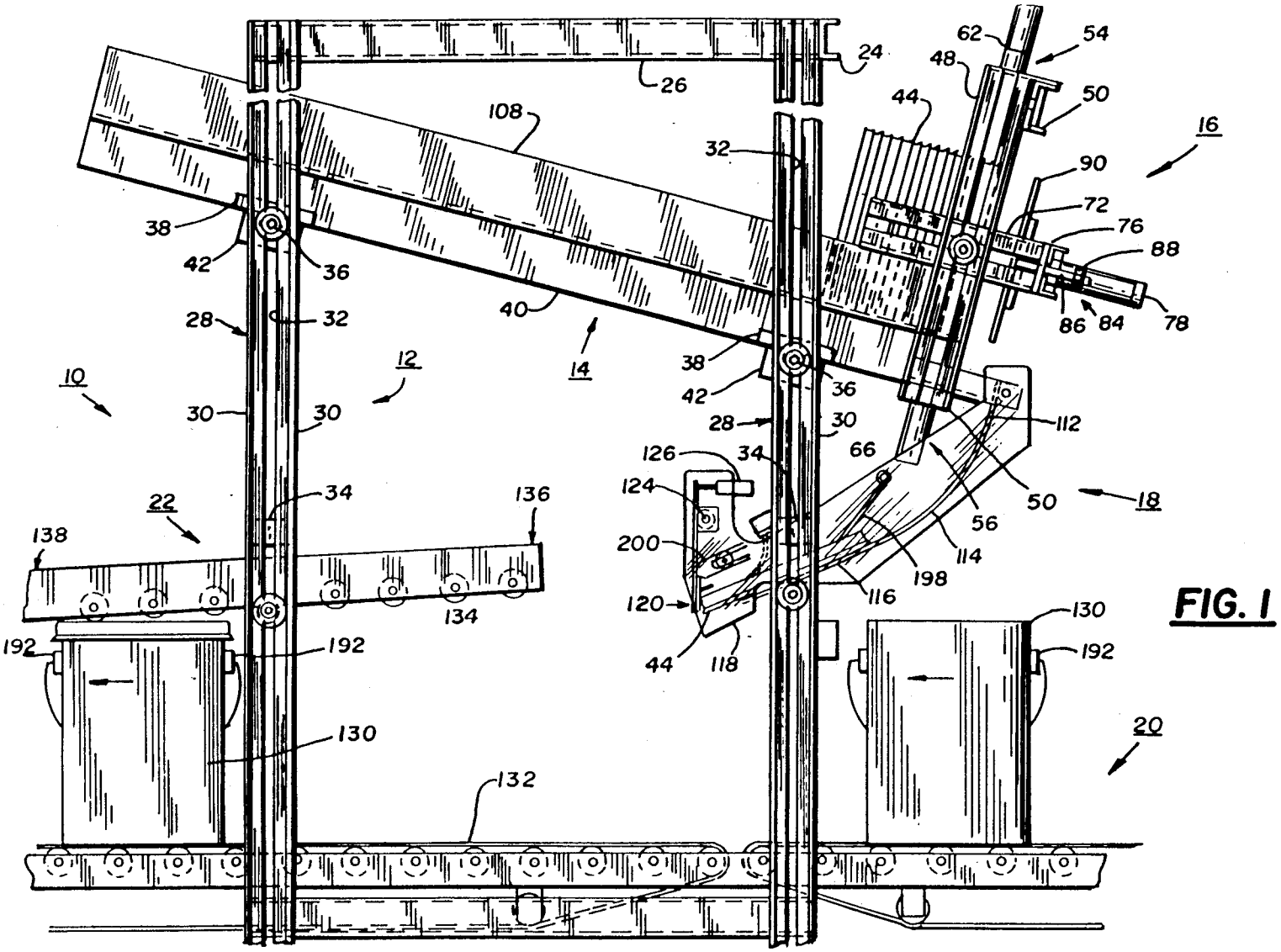
FIG. 1 represents an elevational view, partly diagrammatic and with portions broken, of the apparatus of the present invention, this view particularly showing the apparatus with, respect to a traveling preformed container.

Referring to FIG. 1, a cover or lid separating and placing apparatus, generally identified as 10, includes a main frame assembly 12; an inclined hopper assembly 14; a cover separating assembly 16; a transfer chute assembly 18; an infeed conveyor assembly 20; and a cover seating assembly 22.

Still referring to FIG. 1, the main frame assembly 12 is preferably made of structural steel components including at least one top cross member 24, a pair of top rail members 26, and a plurality of vertical leg members 28. Each of the leg members 28 preferably extend to a floor of the packaging facility (not shown). These leg members 28 preferably are made from structural angle members 30. These structural angle members 30 are arranged to provide a substantially channel shaped configuration having a substantially uniform space 32 along the entire length of the leg members 28. Intermediate strap members 34 may be selectively positioned along the length of the leg members 28 to provide reinforcement. The size of the angles 30 and quantity of strap members 34 is dependent on the loading which the main frame 12 will support. The leg members 28 should be anchored to the floor (not shown) in a plum or level condition by means of accepted and approved means.

Still referring to FIG. 1, an inclined hopper assembly 14 is adjustably mounted to the leg members 28 of the main frame 12. The uniform space 32, in the leg members 28, provides for a substantially unlimited vertical adjustment of the hopper assembly 14 as well as permitting various angles of incline to be selected. An incline of 23 degrees with the horizontal has been found to give the desired results. Of course other angles may be selected to optimize the performance of the apparatus of the present invention.

Figure 2:
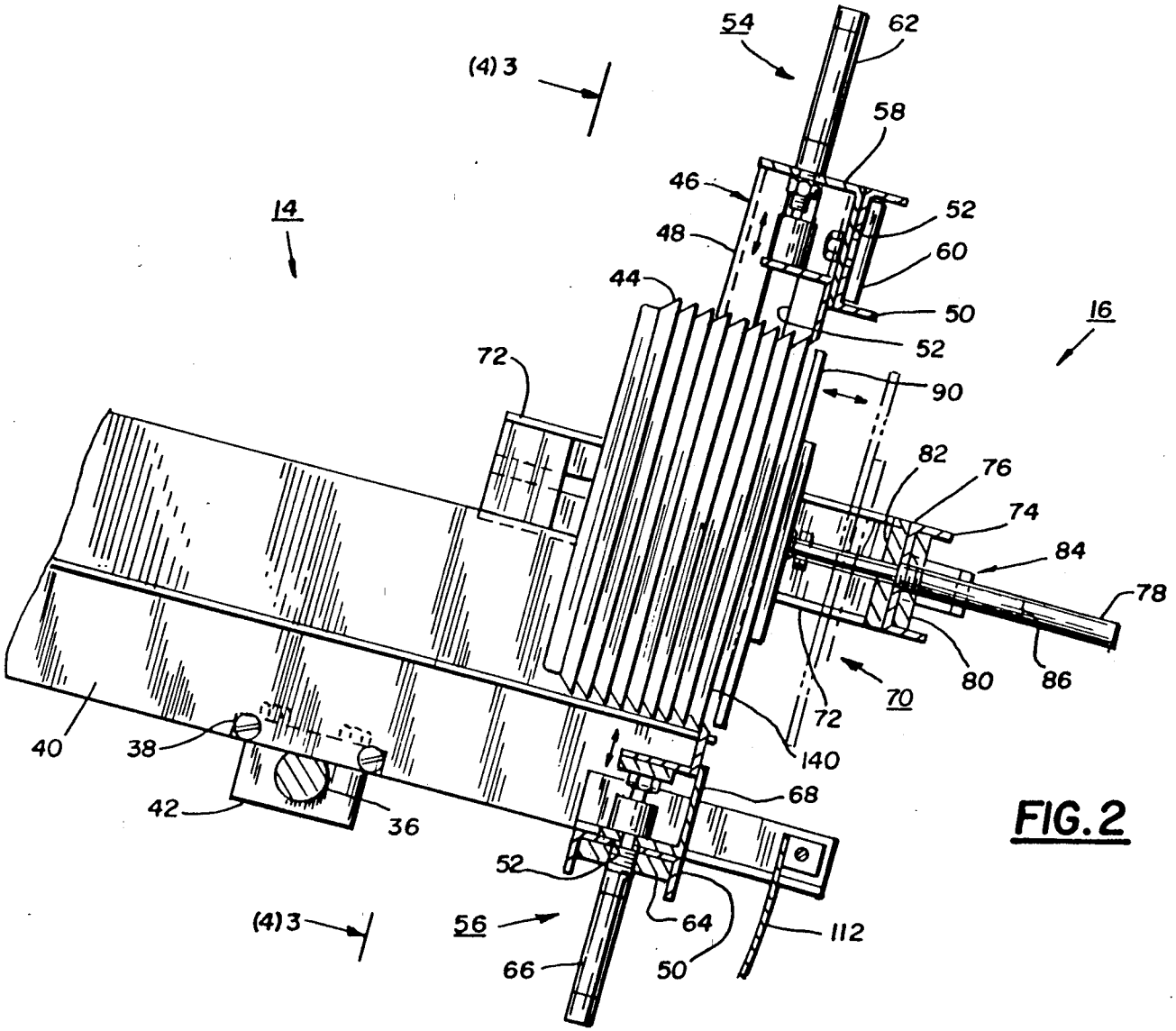
FIG. 2 represents a fragmentary view of a cover separating assembly carried on the end of a hopper, this view being taken in the same direction as FIG. 1 but in an enlarged scale.

Referring now to FIG. 2, the hopper assembly 12 including the cover separating assembly 16 are adjustably carried on and by cross-shaft members 36. Bracket members 38 are fastened to each elongated side plate 40. A clamp 42 is employed to grip each of the cross shaft 36 thereby maintaining a selected and preferred spacing between each of the side plates 40, as may be seen in FIG. 3 and FIG. 4. This preferred spacing provides for the proper guidance and alignment of preformed covers 44R (round) or 44S (square corners) in cooperation with appropriate guides, which will be discussed later.

Referring again to FIG. 2, the cover separating assembly 16 includes a substantially rectilinear frame 46 which is adjustably and removably fastened to a lower end of each of the elongated side plates 40. This frame 46 includes a pair of vertical members 48 and a pair of horizontal members 50. Each of the vertical members 48 and horizontal members 50 have a cross-sectional profile similar to the vertical leg members 28, that is a channel shape having a substantially continuous central slot 52 provided therein. This central slot 52 in the horizontal members 50 and the vertical members 48 allow for adjustable positioning of the other components of the cover separating assembly 16.

Figure 3:
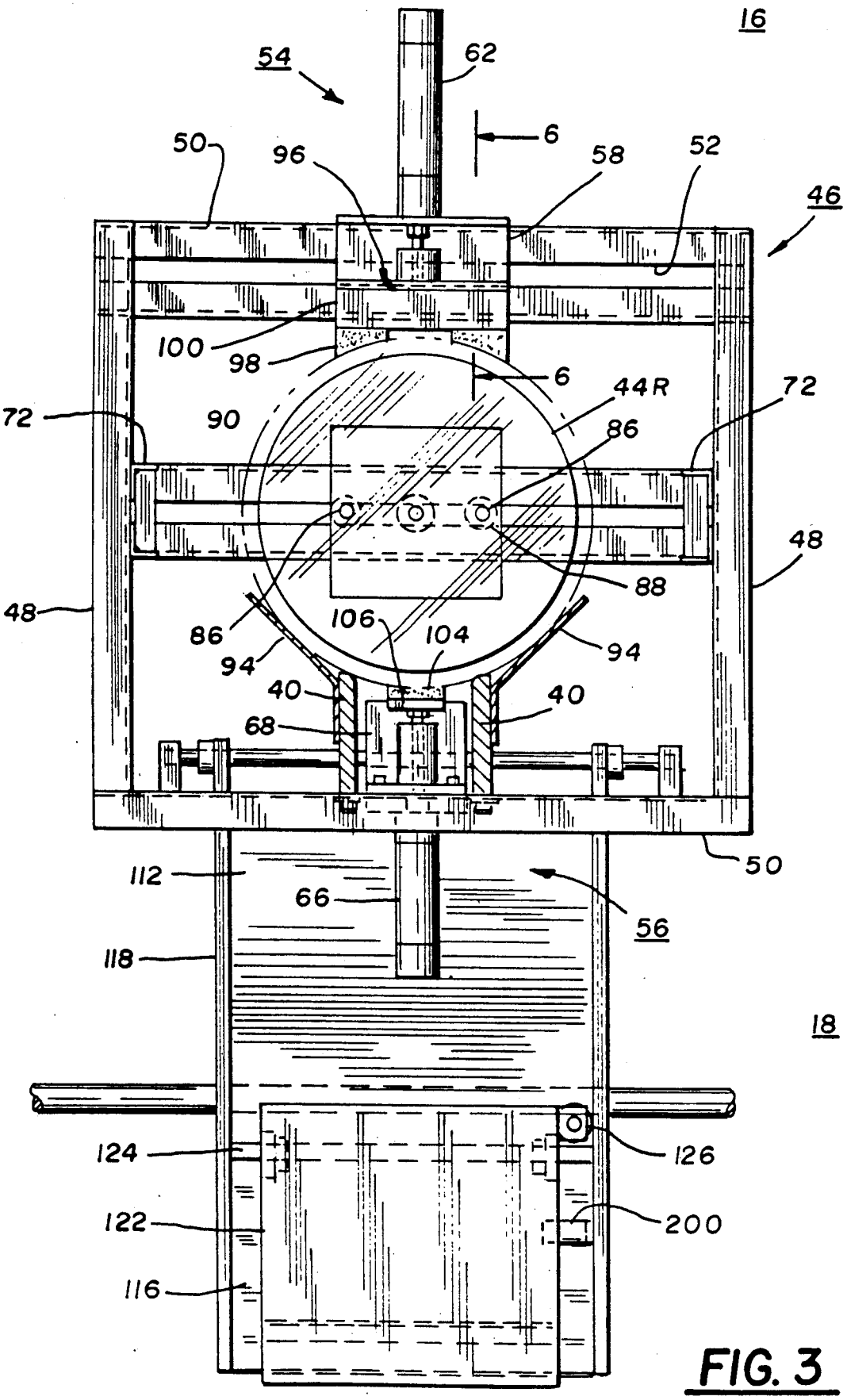
FIG. 3 represents a sectional view of the cover separating assembly, this view being taken along line 3—3 of FIG. 2 and particularly showing a circular cover.

Referring to FIG. 2; FIG. 3; and FIG. 4, a first retaining means 54 is adjustably and removably mounted to the horizontal member 50 located at the top of the frame 46. A second retaining means 56 is adjustably and removably mounted on the horizontal member 50, which is located at the bottom of the frame 46. The first retaining means 54 includes an angled bracket 58 which is clamped to the horizontal member 50, by a clamping bar 60. A first linear actuator 62 is removably fastened to the angle bracket 58 by a suitable means.

The second retaining means 56, includes a short bar 64 adapted for carrying a second linear actuator 66. This short bar 64 is also adapted and sized to fit between the legs of its associated horizontal member 50. An anti-rotation means 68, in the form of an angle shaped member, also provides a clamping means for gripping of the horizontal member 50, at the bottom of the frame 46.

A cover stop means 70 is adjustably and removably carried on the vertical members 48 of the frame 46. The mounting and gripping arrangement is similar to the mounting arrangement used in the first retaining means 54 and second retaining means 56. This adjustable gripping arrangement allows for the centering of the cover stop means 70 with respect to the: cover 44R or 44S in a selected vertical array.

The cover stop means 70 includes a pair of extending arm members 72 adjustably fastened to the vertical members 48. A cross-bracket member 74 is mounted to the outwardly positioned end 76 of the extending arms 72. This cross-bracket member 74 has a substantially channel shaped profile and is adapted to provide a substantially continuous elongated aperture similar to the uniform space 32 of the vertical leg members 28. This cover stop means 70 further includes a third linear actuator 78 which is adjustably and removably carried on the cross-bracket member 74. The third linear actuator 78 includes an actuator mounting bar 80 adapted for retaining the third linear actuator 78 and a clamp bar 82. This clamped arrangement provides a means for aligning the cover stop means 70 with the cover 44R or 44S in a selected horizontal array. The cover stop means 70 also includes a linear stroke adjustment means 84 which controls the length of the inward or left-ward advancement of the cover stop means 70. This stroke adjustment means 84 may take the form of an elongated shaft 86 and clamp collar 88, as may be seen in FIG. 1, or as a stop means attached to one end of a double extending shaft of a linear actuator 78. The arrangement of the shaft 86 and collar 88 simultaneously provides an anti-rotation means when anti-rotation properties are required. It is to be noted that the first, second, and third linear actuators are preferably pneumatic cylinders, but other types of actuators may be used.

Referring again to FIG. 2; FIG. 3., and FIG. 4, the cover stop means 70 further includes a selectively shaped stop plate 90. This stop plate 90 is preferably sized and shaped to conform to the outline of the preformed cover or lid 44R or 44S. It is preferred that the stop plate 90 be substantially planar and extend substantially to or beyond the lip portion 92 of the preformed cover 44R or 44S.

Referring now to FIG. 3, the hopper assembly is adapted for a circular preformed cover 44R. The covers 44R are guided by a pair of guide means 94. Each guide means 94 is removably fastened to a side plate 40. As previously noted, each of the side plates 40 is individually and independently adjustable. This individual adjustment provides for the proper guidance and alignment of the covers 44R. Preferably each guide means 94 is fabricated from sheet metal and formed to a desired shape. The shape may form a V-like configuration as shown or other suitable shape.

Figure 6A:
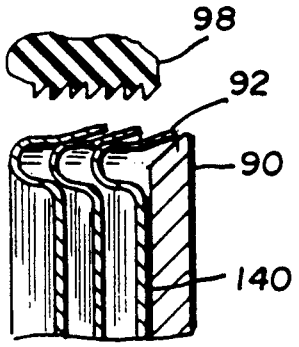
FIG. 6A represents a fragmentary sectional view of an alternate embodiment of a retaining means, this view in an enlarged scale and particularly showing a cover in a non-retained condition.
Figure 6B:
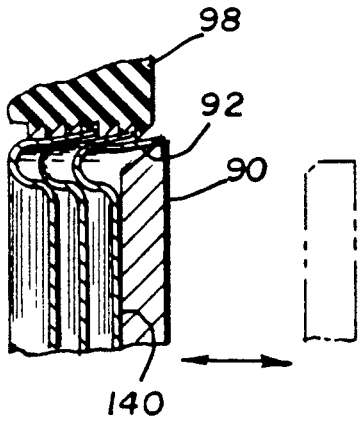
FIG. 6B represents a fragmentary sectional view of the alternate embodiment of a retaining means, this view in an enlarged scale and showing the cover in a retained condition.

The first retaining means 54 preferably has an upper retaining shoe 96 attached to a piston shaft of the first linear actuator 62. This upper shoe 96 is a resilient friction material 98 mounted on a substantially rigid backing means 100. The resilient material 98 may have a flat surface for contacting the second and subsequent covers 44R or a toothed surface as shown in FIG. 6A and 6B. The type surface of the resilient material 98 is a matter of choice which is based on the type of cover being retained. The upper shoe 96 is preferably shaped to follow the outline of the cover diameter. This shaping of the upper shoe 96 may be in the form of angled segments as shown in FIG. 4 or as a continuously curved segment.

Referring now to FIG. 2 and 3, the second retaining means 56 has a lower retaining shoe 102 mounted on the piston rod of the second linear actuator 66. Retaining shoe 102 has a resilient material 104 carried on a substantially rigid backing member 106. A preferred alignment of the lower retaining shoe with the covers 44R is provided by the anti-rotation means 68. The resilient member 104 should have a surface similar to the upper retaining shoe 96.

Figure 4:
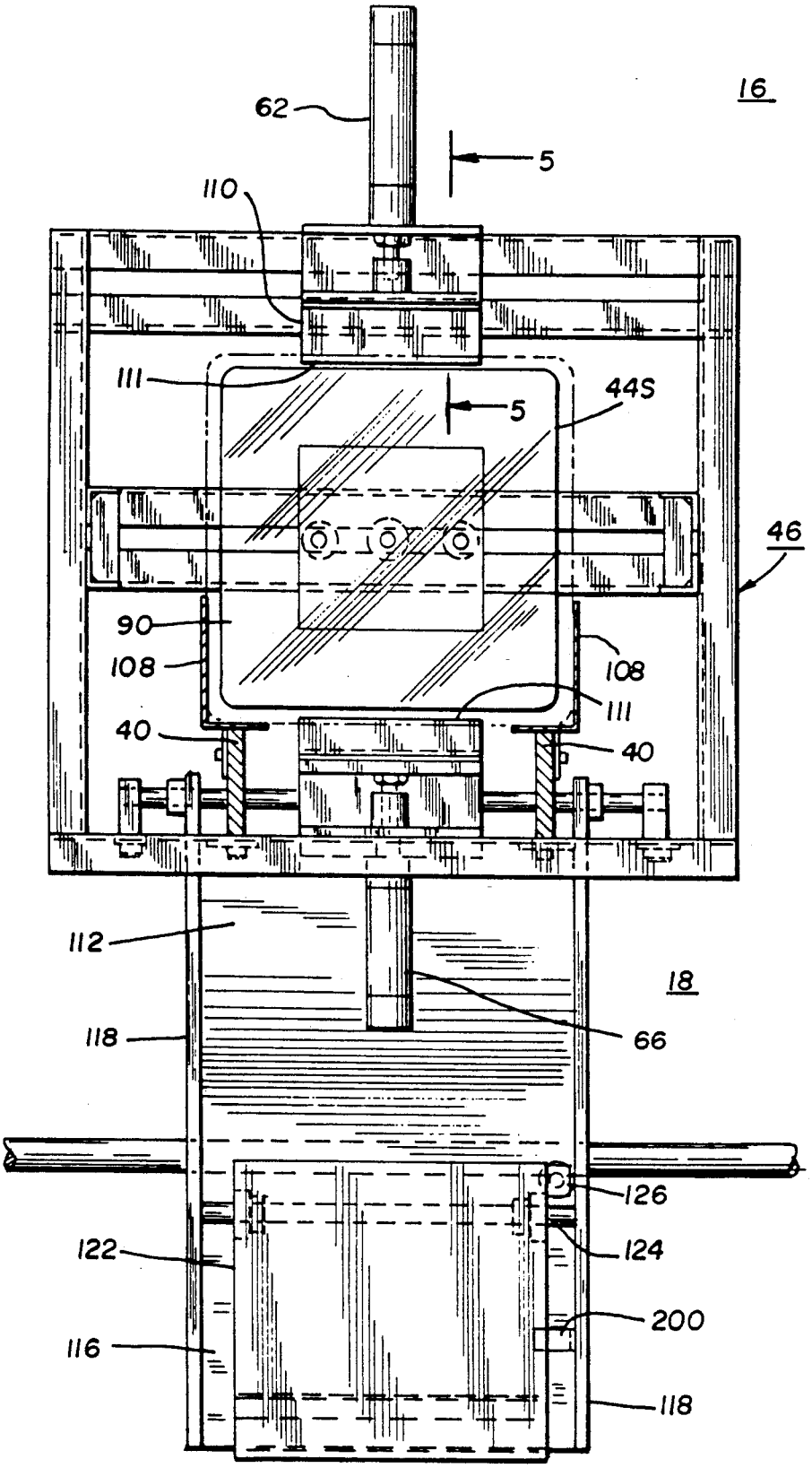
FIG. 4 represents a sectional view of the cover separating assembly, this view being taken along line 4—4 of FIG. 2 and particularly showing a rectangular cover.

Referring now to FIG. 4, a typical hopper assembly 14 and cover separating assembly 16 is shown for rectilinear covers 44S. A pair of guide means 108 provide guidance for the covers 44S held in the inclined hopper assembly 14. Each of the guide means 108 is carried on each of the individually adjustable elongated side plates 40. The guide means 108 may take the form of angle members, as seen in FIG. 4, or as a plurality of elongated rod-like rail members.

The first retaining means 54 of FIG. 4 includes a pair of non-resilient retaining shoes 110. The non-resilient retaining shoes 110 may be exactly alike. Each of the retaining shoes 110 are adapted for mounting on and to their associated piston rods of the first linear actuator 62 or the second linear actuator 66. Preferably the non-resilient retaining shoes 110 have a beveled edge 111, as may be seen in FIG. 5A and 5B.

Referring again to FIG. 1, the transfer chute assembly 18 is pivotally suspended from the lower horizontal member 50 of the cover separating assembly 16. This transfer chute assembly 18 includes a receiving end 112; a curved transition portion 114; and an elongated inclined portion 116. Guidance for any covers 44R or 44S sliding on the transfer chute assembly 18 is provided by a pair of shaped edge guides 118 which are held in spaced alignment. The cover supporting surface of the transfer chute assembly 18 may be a continuous sheet or individually spaced rail members. Alternatively the cover supporting surface may be made from material having an embossed pattern to minimized surface contact. The design of the cover supporting surface is a matter of design choice as to which surface will provide the preferred sliding properties.

The transfer chute assembly 18 has a discharge end 120 at its lowermost end, distal the receiving end 112. Typically the discharge end 120 includes a gate member 122 pivotally mounted in and on the edge guides 118 by a shaft 124. Preferably the operation of the gate member 122 is controlled by selectively activated closing means 126 such as a fourth linear actuator The activated closing means 126 limits the opening of the gate member 122 to only when a container 130 is in the desired position. It is to be noted that a non activated closing means such as a spring biased or counter-balanced gate member 122 may be used when the covers are relatively light in weight.

A top guide bracket 131 is mounted on the inside portion of the gate member 122 to limit any lifting action which may occur during the selection or engagement of the cover 44R or 44S by the container 130.

Referring still to FIG. 1, a cover seating assembly 22 includes a discharge conveyor 132 and an upper roller assembly 134. The discharge conveyor 132 preferably is a belt conveyor which is continually being driven by a drive means not shown. The upper roller assembly 134 is adjustably mounted to at least one of the vertical leg members 28. The upper roller assembly 134 is preferable arrayed at an incline with regard to the discharge conveyor 132, that is the distance between the upper roller assembly 134 and the the discharge conveyor 132 is greater at the container entering end 136 than at the container leaving end 138. This cover seating assembly 22 receives a container 30 with a cover engaged at least at one point along the periphery of the container 130. The cover will be completely seated upon the mouth of the container 130 by the compression force provided by the cooperating action of the discharge conveyor 132 and the upper roller assembly 134. It is to be noted that a driven belt conveyor may also used in place of the upper roller assembly 134.

USE AND OPERATION

The separating and the placing of covers or lids 44R or 44S is performed automatically by the present invention. In addition to automatic operation, the present invention provides an "on demand" separation and placement of the lids. The "on demand" operation is characterized by a control system which will stop the advancement of a container 130 on an infeed conveyor assembly 20 when a cover or lid is not available at the discharge end 120 of the transfer chute assembly 18. The control system also prevents the escapement of a cover or lid from the discharge end 120 prior to the engagement or selection by the mouth of a container 130.

Referring to FIG. 1, a quantity of preformed covers 44R are loaded in and on the inclined hopper assembly 14. The covers 44R or 44S are loaded in the hopper in a nested condition with an interior surface 140 of the cover facing toward the cover separating assembly 16, as may be seen in FIG. 5A and 6A. The quantity of covers placed in the hopper assembly 14 is limited by the length of the side plates 40 and guide means 108. This arrangement is satisfactory for most liding operations.

Referring now to FIG. 6A, the nested stack of covers come to rest against the stop plate 90. It is to be noted that the stop plate 90 is in its fully extended or left-ward position. The extended position of the stop plate 90 is controlled by the linear stroke adjustment means 84. Preferably the extended stop plate 90 positions the lip 92 of the second cover of the nested stack in a predetermined alignment with the resilient shoe 98. Of course the second cover must also be in alignment with the resilient material 104 of the second retaining shoe 102.

Since this is an "on demand" apparatus, it is necessary to manually place a first cover at the discharge end 120 of the transfer chute assembly 18. After this manual placement the operation is fully automatic and responsive to the removal of a cover from the discharge end 120 by a traveling container 130.

Upon removal of a cover 44R by a traveling container 130, the first retaining means 54 and the second retaining means 56 are moved to an extended position to engage at least the second cover of the nested stack by and with the upper retaining shoe 96 and the lower retaining shoe 102. It is to be noted that when using resilient retaining shoes, it is may be desirable to contact more than just the second cover. This is dependent on the size and weight of the covers and also the quantity of covers retained or supported by the first retaining means 54 and the second retaining means 56.

After the first retaining means 54 and the second retaining means 56 are extended and cooperate to retain the second and subsequent covers from advancing down the hopper, a first sensing means associated with the first retaining means 54 and a second sensing means associated with the second retaining means 56 are serially connected to provide a signal for the cover stop plate 90 of the cover separating assembly 16 to retract or move to the right as may be seen in FIG. 2. As the cover stop plate 90 retracts, the first cover falls away from the second cover of the nested stack. The retracted position of the cover stop plate 90 is adjusted to be in substantial alignment with the receiving end 112 of the transfer chute assembly 18.

The separated cover 44R slides vertically down the receiving end 112 by gravity. The separated cover 44R is then tilted to an inclined position relative to horizontal as it passes through the curved transition portion 114. The cover finally comes to rest at the discharge end 120 of the elongated inclined portion 116. The gate member 122 is held closed by the activated closing means 126 to retain the cover 44R at the discharge end 120. A third sensor is mounted at the discharge end 120 for detecting the presence of a cover 44R at the discharge end 120. This third sensor signals the third linear actuator 78 to move the cover stop plate 90 to an extended or leftward position and also cooperates with a fourth sensing means, selectively located on the infeed conveyor assembly 20, to provide a control signal for allowing the advancement of the container 130 carried on the infeed conveyor assembly 20. If a cover was not present at the discharge end 120, the advancement of the container 130 would be stopped by stopping the infeed conveyor 20 as and when the container 130 is detected by the fourth sensing means.

After the cover plate 90 is fully extended as controlled by the third sensing means, a fifth sensing means adapted for sensing the full extention of the cover stop plate 90 signals the first retaining means 54 and the second retaining means 56 to retract to a non-retained condition. This non-retained condition allows the nested stack of covers to advance downward and come to rest against the extended cover stop plate 90.

It is to be noted that when a large quantity of heavy covers are held in the hopper it may be necessary to provide a third retaining means (not shown) and an opposite fourth retaining means (not shown) at a position of between 18 cm. to 27 cm. to the left side of the first retaining means 54 and the second retaining means 56. The third retaining means and fourth retaining means would be substantially identical to and operate simultaneously with the first retaining means 54 and second retaining means 56.

Figure 5A:
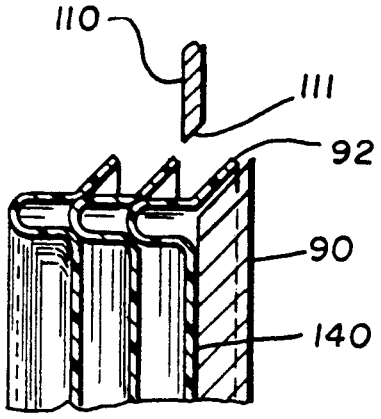
FIG. 5A represents a fragmentary sectional view of one embodiment of a retaining means, this view in an enlarged scale and particularly showing the covers in a non-retained condition.
Figure 5B:
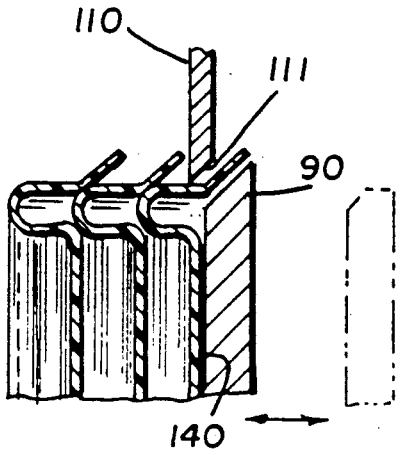
FIG. 5B represents a fragmentary sectional view of one embodiment of a retaining means, this view in an enlarged scale and showing a cover in a retained condition.

Referring now to FIG. 4 and FIG. 5A, the use and operation of each of the retaining shoes 110 is substantially the same as mentioned above. The use of the non-resilient shoes 110 is particularly useful with covers having at least 2 opposed straight sides. In this arrangement, the non-resilient shoe 110 is aligned with or just forward of the second cover 44R. The beveled edge of the non-resilient retaining shoe 110 has been found to help in the separation of the first cover from the nested stack.

Figure 7:
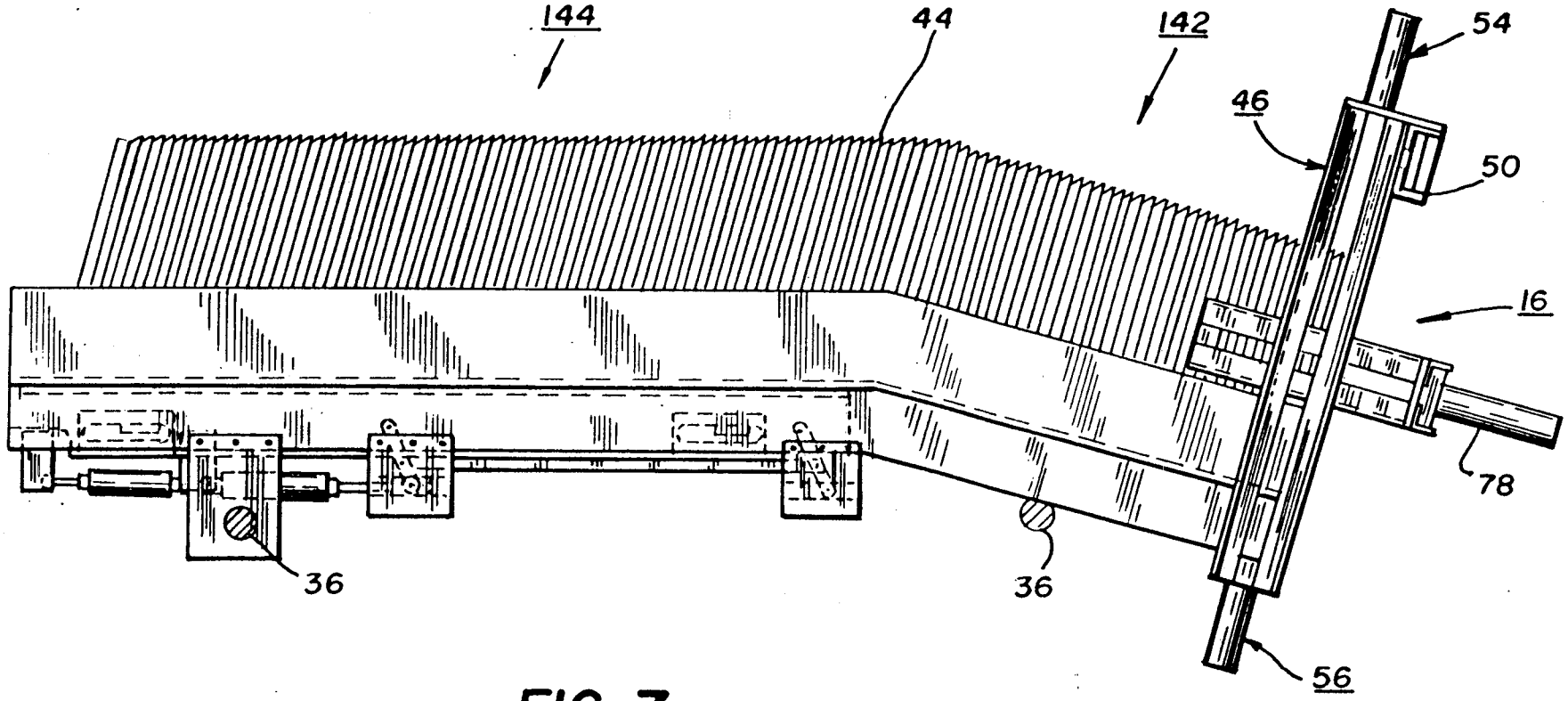
FIG. 7 represents a side elevational view of the lid separating assembly, this view substantially in the same scale as FIG. 1 and showing an alternate embodiment for a hopper.

Referring now to FIG. 7, an alternate hopper assembly, generally identified as 142 is shown. In this alternate embodiment the hopper assembly 142 includes a walking beam portion 144 and an inclined portion 146. The walking beam portion is substantially similar to the walking beam arrangement as disclosed in my U.S. Pat. No. 4,601,160; FIG. 13. This alternate hopper assembly allows for the automatic filling of the inclined portion 146 and also reduces the loading on the first retaining means 54 and the second retaining means 56.

It is to be further noted that some type of covers may require the use of a suction means or a magnet means similar to the separating means as described in my U.S. Pat. No. 4,959,944. As previously mention U.S. Pat. No. 4,959,944 is incorporated by reference into this application to the extent the law allows.

DESCRIPTION OF THE ALTERNATE EMBODIMENT OF FIG. 8 AND FIG. 9

Figure 8:
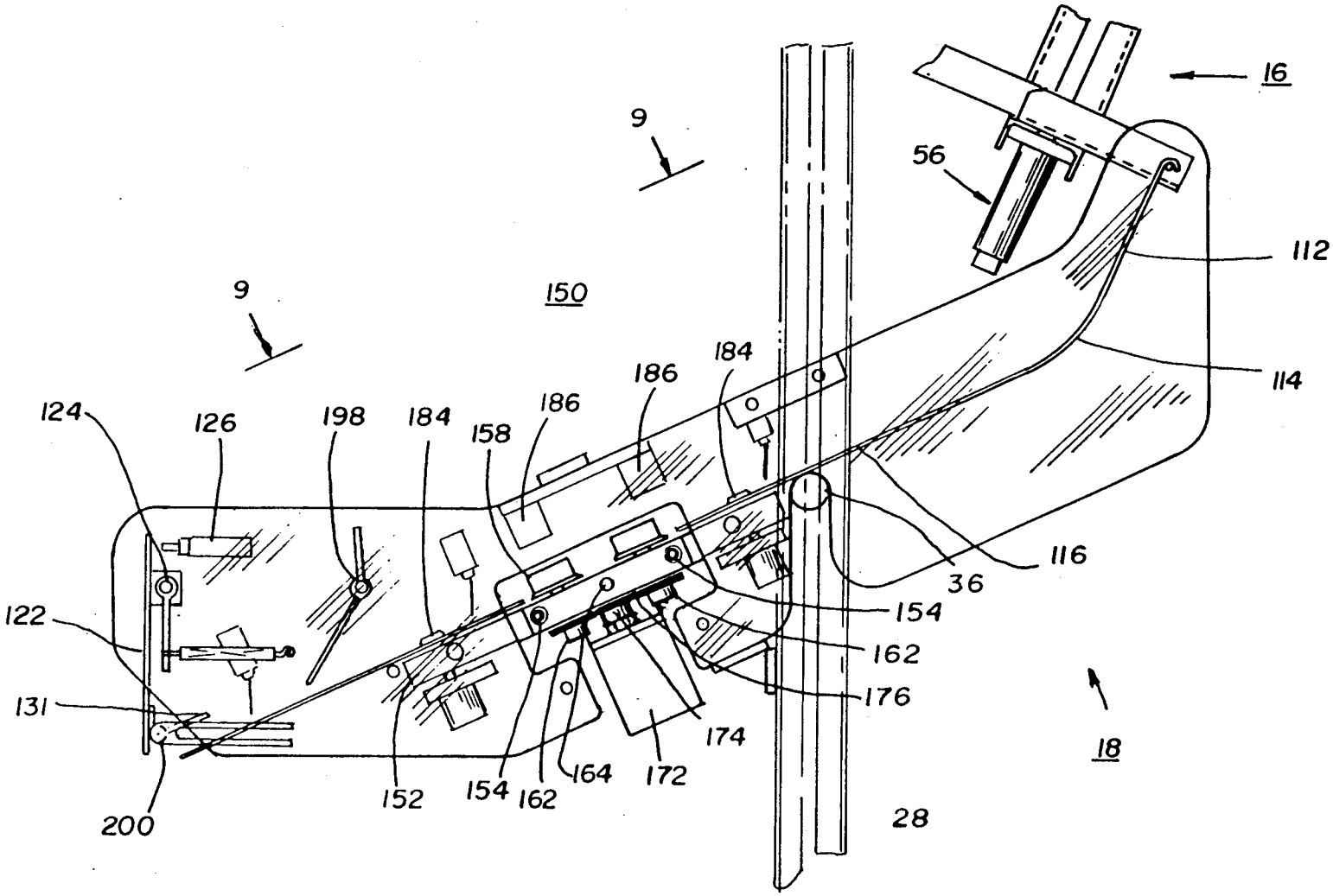
FIG. 8 represents a side elevation of an alternate embodiment of a transfer chute assembly, this view particularly showing a lid orienting means.
Figure 9:
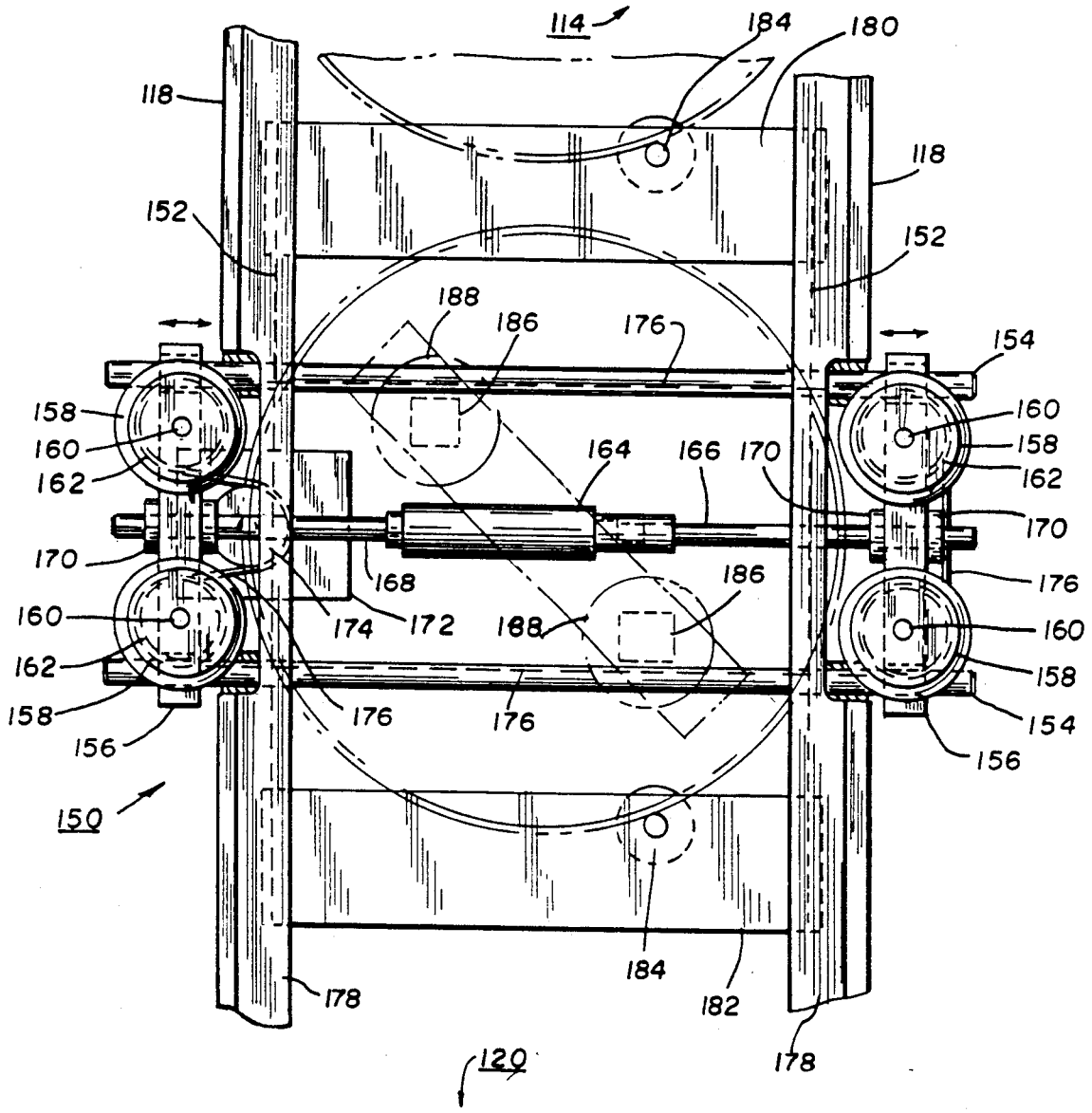
FIG. 9 represents a plan view of the lid orienting means, this view in an enlarged scale and taken along line 9—9 of FIG. 8.

Referring now to FIG. 8, a lid orienting assembly 150 is placed at approximately the mid-point of the elongated inclined portion 116 of the transfer chute assembly 18. This orienting assembly 150 includes a pair of elongated side rail members 152 which are mounted to the underside of the transfer chute assembly 18 in a selectively spaced relationship. A pair of shaft members 154 are removably mounted in and through the side rail members 152. The shaft members 154 are of sufficient length to allow a predetermined length to extend beyond the side rails 152. Each of a pair of bearing bars 156 is slidably carried on each extending portion of the shaft members 154. A pair of wheel members 158 are fixed to axle members 160. Each wheel member 158 has a single flanged portion extending from the lowermost face of each wheel member 158. Each of a pair of axle members 160 is rotatably carried in the bearing bar 156. A pulley member 162 is locked to the end of each axle member 160, distal to the wheel member 158. The body of a linear actuator 164 is fastened to one of the bearing bars 156 by means of an elongated adapter rod 166. A piston rod 168 of the linear actuator 164 is connected to the second bearing bar 156. The piston rod 168 and the adapter rod 166 are retained in each of their respective bearing bars 156 by a pair of clamp collars 170.

A drive means 172 such as an electric gear motor is mounted to one of the bearing bars 156. This drive means has a drive pulley 174 attached to its drive shaft. A continuous drive belt 176 is threaded in a serpentine array around the drive pulley 174 and each pulley member 162 to simultaneously drive all wheel members 158 in a like direction. The drive belt 176 is preferably a polyurethane belt with a round cross section. This type of belt is elastic and will allow for expansion and contraction as needed. The elastic properties will become apparent later in the description.

The transfer chute 18 for this orienting assembly 150 has an open central portion resulting in two rail members 178. The distance between the rail members allows spouts or bungs, which may protrude, to rotate freely without interference.

An upper bracket member 180 and a lower bracket member 182 are fastened to the side rail members 152 at predetermined positions. A retractable stop pin 184 is selectively mounted to each of the upper bracket 180 and the lower bracket 182. The stop pins 184 are positioned off center with respect to the elongated inclined portion 116. This selective positioning of the stop pins 184 causes a cover 44R to be correctly and consistently positioned with respect to one pair of wheel members 158. A pair of orientation sensors 186 are selectively positioned and suspended above the cover 44R by a mounting means (shown in dashed outline). This mounting means preferably is pivotable and lockable to locate and hold the orientation sensing means 186 at a selected position while maintaining each of the sensing means 186 in a diametrically opposed array.

USE AND OPERATION

The orientation assembly 150 of the present invention is adapted for selectively aligning the pour spout or bung 188 of a round cover 44R with respect to a container 130. More specifically, the handle 190 of the container 130 is positioned preferably with the handle pivots 192 substantially aligned in the direction of container travel, as may be seen in FIG. 1. Each time a cover 44R is removed from the discharge end 120 of the transfer chute assembly 18, the third sensor signals the stop pin 184 mounted on and in the lower bracket member 182 to retract. This retraction of this stop pin 184 allows an oriented cover to move from the orienting position to the discharge position 120. A first switch 194 detects the absence of a cover at the orienting assembly 150. This negative determination by this first switch 94 retracts the stop pin 184 mounted in the upper bracket 180.

The action of the stop pins 184 may be considered sequential. That is as the oriented cover moves into the discharge position and the first switch 194 makes a negative determination the lower stop pin 184 extends to engage the next cover 44R, while the upper stop pin 184 is retracted. The cover 44R moving into the orienting position is stopped by the lower stop pin 184 and provides a positive determination to the first switch 194. The positive determination of the first switch 194 energizes the linear actuator 164 causing the constantly rotating wheel members 158 to contact the cover 44R. The flange portion of the wheel members 158 support the lip of the cover while simultaneously slowly rotating the cover 44R until the pour spout is sensed by one of the orientation sensors 186. The use of two orientation sensors 186 results in the rotation of the cover for less than 180 degrees. A positive determination by the orientation sensors 186 causes the linear actuator 164 to return to a inactive or out condition to remove contact between the cover and the wheel members. The pour spout 188 is now positioned so as not to interfer with the handle.

When the second switch 196 has a negative determination, that is a cover is not present, The upper stop pin 184 extends and simultaneously signals the cover separating assembly to drop a cover 44R into the receiving end of the transfer chute assembly 18. The separating action is similar to that as previously described above in connection with FIG. 1.

In the description above, reference has been made to sensing means, switches and orientation sensors. Preferably the orientation sensors are of a photoelectric type, but proximity sensors may be used when appropriate. The switches are preferably pneumatic switches with cats wisker operators, but electrical switches with similar operators may be used. The first, second, etc sensing means preferably are pneumatic threshold valves to determine the absence of air pressure at the end of the stroke of a pneumatic linear actuator.

A hold down member 198 may be selectively positioned and pivoted on the edge guides 118 of transfer chute assembly 18, This hold down member 198 provides at least one of the following functions: (a) a brake to slow the velocity of the sliding cover; (b) a pawl-like function to resist a rebounding or bounce-back of the cover after contact with the gate member 122; (c) to stop any lifting of the cover at the discharge position. The gate member 122 preferably is provided with an adjustable and lockable positioning means 200 for properly positioning the cover at the discharge end 120. This positioning means 200 locates the gate member 122 when acted upon by the closing means 126 or by a counter-balance.

Terms such as "left", "right", "up", "down", "bottom", "top", "front", "back", "in", "out" and the like are applicable to the embodiments shown and described in conjunction with the drawings. These terms are merely for the purpose of description and do not necessarily apply to the position in which the separating, placing, and orienting apparatus of the present invention may be employed.

While these particular embodiments of a separating, placing, and orienting apparatus have been shown and described, it is to be understood that the invention is not limited thereto and protection is sought to the broadest extent the prior art allows.

What is claimed is:

1. An improved apparatus for separating, feeding, metering, and placing of a preformed cover onto a traveling preformed container, said preformed cover being a first and lowermost cover of a nested stack, said apparatus including:

(a) a main frame assembly;

(b) an inclined hopper assembly adjustably mounted on said main frame assembly, said hopper assembly adapted for advancing said nested stack of covers towards a cover separating assembly, said advancing of said nested stack in a direction substantially opposite to a direction of advancement for said traveling preformed container;

(c) said cover separating assembly adjustably carried on a lowermost end of said hopper assembly, said cover separating assembly including, a frame member carrying a first retaining means, a second retaining means, and a cover stop means, said first retaining means and second retaining means selectively actuated for retaining at least a second of the preformed covers in the nested stack, said first retaining means and second retaining means cooperating to retain said second cover and subsequent covers from advancing down said inclined hopper during a selected period, said cover stop means adapted to provide an extent to the advancing of said nested stack when and as said nested stack is not retained by said first and second retaining means, said cover stop means also providing for the subsequent separation of said first cover from retained said second cover, and said cover stop means further adapted for allowing said first cover to fall into and onto a transfer chute assembly by gravity;

(d) a first sensing means for determining the retention of a top portion of the second cover by said first retaining means independently of the distance traveled by said first retaining means, a second sensing means for determining the retention of a bottom portion of the second cover by the second retaining means, independently of a distance traveled by the second retaining means, said determination of said first sensing means and said second sensing means providing for the actuation of the cover stop means for providing said separation of said first cover from said second cover;

(e) said transfer chute assembly being carried on said frame member of the cover separating assembly, said transfer chute assembly including a receiving end, a curved transition portion, and an elongated inclined portion, said receiving end adapted for receiving said first cover guided by said cover stop means, said curved transition portion adapted for tilting said first cover, advancing by gravity thereon, from a substantially vertical disposition to a selected inclined disposition on said elongated inclined portion, said inclined portion including a discharge end, said inclined portion adapted for advancing said first cover, by gravity, to and towards the discharge end;

(f) a placing assembly mounted at and on said discharge end of the elongated inclined portion, said placing assembly adapted to guide and subsequently stop advancement of said first cover in substantially centered alignment with said traveling container, said placing assembly further providing a means for engaging a leading edge of the traveling container with a mating portion of the first cover, said placing assembly further adapted for selectively releasing said first cover onto said traveling container; and (g) a third sensing means adapted for sensing the presence of a cover at said discharge end of said transfer chute assembly, said third sensing means providing a control signal for the selective advancement or the stopping of said preformed container on an infeed conveyor prior to reaching said discharge end.

2. An improved apparatus as recited in claim 1 wherein said means for engaging at said placing assembly includes a pivoting gate member, said pivoting gate member being selectively positioned for stopping said advancement of said first cover, said gate member further adapted for selectively positioning said first cover for said engaging of the leading edge.

3. An improved apparatus as recited in claim 2 wherein said placing assembly further includes a closing means for urging said gate member to a selected closed position prior to and after said engaging of the leading edge of said traveling container by said first cover.

4. An improved apparatus as recited in claim 3 wherein said placing assembly further includes a adjustable locating means for providing said selected closed position of said gate member.

5. An improved apparatus as recited in claim 3 wherein said closing means is selectively actuated, said selective actuation providing positive positioning of said gate member and occurring during the absence of a container at a selected position on said infeed conveyor.

6. An improved apparatus as recited in claim 3 wherein said placing assembly includes a pivoting hold down means, said pivoting hold down means being selectively positioned at said discharge end for providing a means for slowing the advancement of the first cover, said hold down means further providing a limit to the amount of rebounding occurring as and when said advancing cover is stopped by said gate member.

7. An improved apparatus as recited in claim 1 wherein said inclined hopper includes a pair of adjustable and removable guide means, said guide means adapted for holding and guiding like sized and shaped nested preformed covers.

8. An improved apparatus as recited in claim 1 wherein said cover stop means includes a cover stop plate, said cover stop plate selectively sized to extend to a lip portion of said first cover, said cover stop plate being further adapted for allowing an inside surface of said first cover to easily slide thereon prior to and during entry of said cover into said receiving end.

9. A improved apparatus as recited in claim 1 wherein said first retaining means includes an upper shoe member, and a linear actuator, said linear actuator adapted for selectively moving said upper retaining shoe between said retained condition and a non-retained condition.

10. An improved apparatus as recited in claim 9 wherein said second retaining means includes a lower retaining shoe and a selectively actuated second linear actuator, said second linear actuator being adapted for selectively moving said lower retaining shoe between said retained condition and a non-retained condition.

11. An improved apparatus as recited in claim 10 wherein each of said upper retaining shoe and said lower retaining shoe includes a resilient material carried on a substantially rigid backing means, said resilient material adapted for simultaneously conforming to a contour of the peripheral surface of said second cover while retaining said second cover.

12. An improved apparatus as recited in claim 10 wherein each of said upper retaining shoe and said lower retaining shoe is a substantially rigid material, said rigid material being selectively sized and shaped for retaining said second cover of said nested stack.

13. An improved apparatus as recited in claim 1 which further includes a walking beam assembly attached to said hopper assembly distal said separating assembly, said walking beam assembly being adapted for automatically advancing nested covers in a substantially horizontal advancement to and towards said inclined portion of said hopper assembly.

14. An improved apparatus for separating, feeding, metering, orienting, and placing of a preformed cover onto a traveling preformed container, said preformed cover being a first and lowermost cover of a nested stack, said apparatus including:

(a) a main frame assembly;

(b) an inclined hopper assembly adjustably mounted on said main frame assembly, said hopper assembly adapted for advancing said nested stack of covers towards a cover separating assembly, said advancing of said nested stack in a direction substantially opposite to a direction of advancement for said traveling preformed container;

(c) said cover separating assembly adjustably carried on a lowermost end of said hopper assembly, said cover separating assembly including, a frame member carrying a first retaining means, a second retaining means, and a cover stop means, said first retaining means and second retaining means selectively actuated for retaining at least a second of the preformed covers in the nested stack, said first retaining means and second retaining means cooperating to retain said second cover and subsequent covers from advancing down said inclined hopper during a selected period, said cover stop means adapted to provide an extent to the advancing of said nested stack when and as said nested stack is not retained by said first and second retaining means said cover stop means also providing for the subsequent separation of said first cover from retained said second cover, and said cover stop means further adapted for allowing said first cover to fall into and onto a transfer chute assembly by gravity;

(d) a first sensing means for determining the retention of a top portion of the second cover by said first retention means independently of the distance traveled by said first retaining means, a second sensing means for determining the retention of a bottom portion of the second cover by the second retaining means, independently of a distance traveled by the second retaining means, said determination of said first sensing means and said second sensing means providing for the actuation of the cover stop means for providing said separation of said first cover from said second cover;

(e) said transfer chute assembly being carried on said frame member of the cover separating assembly, said transfer chute assembly including a receiving end, a curved transition portion, and an elongated inclined portion, said receiving end adapted for receiving said first cover guided by said cover stop means, said curved transition portion adapted for tilting said first cover, advancing by gravity thereon, from a substantially vertical disposition to a selected inclined disposition on said elongated inclined portion, said inclined portion including a discharge end, said inclined portion adapted for advancing said first cover, by gravity, to and towards the discharge end;

(f) an orienting assembly selectively positioned along said elongated inclined portion between said curved transition portion and said placing assembly, said orienting assembly including:

(f1) at least two pair of wheel members, each of said wheel members adapted for continuous rotation, each pair of wheel members selectively positioned along said elongated inclined portion for simultaneously engaging a peripheral lip portion of said first cover as and when desired for rotating said first cover to an oriented condition, each of said wheel members further adapted for allowing free linear advancement of said first cover therebetween as and when desired;

(f2) a fourth linear actuator adapted for selectively bringing each pair of wheel members to said simultaneously engaging of said lip portion;

(f3) a drive means for rotating each of said wheel members in a selected direction;

(f4) at least one orienting sensor selectively and adjustably positioned above said elongated inclined portion for detecting a selected oriented condition of a pour spout of a first container, wherein a positive determination by said orientation sensor providing for the disengagement of said wheel members from said lip portion, (f5) a lower stop pin selectively positioned and selectively actuated for receiving and positioning said first cover at said orienting assembly;

(g) a placing assembly mounted at and on said discharge end of the elongated inclined portion, said placing assembly adapted to guide and subsequently stop advancement of said first cover in substantially centered alignment with said traveling container, said placing assembly further providing a means for engaging a leading edge of the traveling container with a mating portion of the first cover, said placing assembly further adapted for selectively releasing said first cover onto said traveling container; and (h) a third sensing means adapted for sensing the presence of a cover at said discharge end of said transfer chute assembly, said third sensing means providing a control signal for the selective advancement or the stopping of said preformed container on an infeed conveyor prior to reaching said discharge end.

15. An improved apparatus as recited in claim 14 wherein said means for engaging at said placing assembly includes a pivoting gate member, said pivoting gate member being selectively positioned for stopping said advancement of said first cover, said gate member further adapted for selectively positioning said first cover for said engaging of the leading edge.

16. An improved apparatus as recited in claim 15 wherein said placing assembly further includes a closing means for urging said gate member to a selected closed position prior to and after said engaging of the leading edge of said traveling container by said first cover.

17. An improved apparatus as recited in claim 16 wherein said placing assembly further includes an adjustable locating means for providing said selected closed position of said gate member.

18. An improved apparatus as recited in claim 16 wherein said closing means is selectively actuated, said selective actuation providing positive positioning of said gate member and occurring during the absence of a container at a selected position on said infeed conveyor.

19. An improved apparatus as recited in claim 16 wherein said placing assembly includes a pivoting hold down means, said pivoting hold down means being selectively positioned at said discharge end for providing a means for slowing the advancement of the first cover, said hold down means further providing a limit to the amount of rebounding occurring as and when said advancing cover is stopped by said gate member.

20. An improved apparatus as recited in claim 14 wherein said inclined hopper includes a pair of adjustable and removable guide means, said guide means adapted for holding and guiding like sized and shaped nested preformed covers.

21. An improved apparatus as recited in claim 14 wherein said cover stop means includes a cover stop plate, said cover stop plate selectively sized to extend to a lip portion of said first cover, said cover stop plate being further adapted for allowing an inside surface of said first cover to easily slide thereon prior to and during entry of said cover into said receiving end.

22. An improved apparatus as recited in claim 14 wherein said first retaining means includes an upper shoe member, and a linear actuator, said linear actuator adapted for selectively moving said upper retaining shoe between said retained condition and a non-retained condition.

23. An improved apparatus as recited in claim 22 wherein said second retaining means includes a lower retaining shoe and a selectively actuated second linear actuator, said second linear actuator being adapted for selectively moving said lower retaining shoe between said retained condition and a non-retained condition.

24. An improved apparatus as recited in claim 23 wherein each of said upper retaining shoe and said lower retaining shoe includes a resilient material carried on a substantially rigid backing means, said resilient material adapted for simultaneously conforming to a contour of the peripheral surface of said second cover while retaining said second cover.

25. An improved apparatus as recited in claim 23 wherein each of said upper retaining shoe and said lower retaining shoe is a substantially rigid material, said rigid material being selectively sized and shaped for retaining said second cover of said nested stack.

26. An improved apparatus as recited in claim 14 which further includes a walking beam assembly attached to said hopper assembly distal said separating assembly, said walking beam assembly being adapted for automatically advancing nested covers in a substantially horizontal advancement to and towards said inclined portion of said hopper assembly.

27. An improved apparatus as recited in claim 14 wherein said transfer chute assembly further includes an upper stop pin, said upper stop pin being selectively positioned between said orienting assembly and said curved transition portion, said upper stop pin being selectively raised and lowered for metering the advancement of said first cover into said orienting assembly position, wherein said upper stop pin and said lower stop pin are selectively and sequentially raised and lowered for allowing only one preformed cover simultaneously in any of said orienting assembly position or said placing assembly position

* * * * *